US007043427B1

(12) United States Patent
Kern et al.

(10) Patent No.: US 7,043,427 B1
(45) Date of Patent: May 9, 2006

(54) APPARATUS AND METHOD FOR SPEECH RECOGNITION

(75) Inventors: Ralf Kern, Bocholt (DE); Karl-Heinz Pflaum, Bocholt (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/646,315

(22) PCT Filed: Feb. 3, 1999

(86) PCT No.: PCT/DE99/00289

§ 371 (c)(1),
(2), (4) Date: Sep. 15, 2000

(87) PCT Pub. No.: WO99/48086

PCT Pub. Date: Sep. 23, 1999

(30) Foreign Application Priority Data

Mar. 18, 1998 (DE) ..... 198 11 879

(51) Int. Cl.
*G10L 21/02* (2006.01)

(52) U.S. Cl. ..... 704/233; 704/226; 381/94.7

(58) Field of Classification Search ..... 704/224, 704/225, 226, 227, 231, 233, 234, 238, 239, 704/243, 244; 381/91, 95, 94.1, 94.7
See application file for complete search history.

(56) References Cited

U.S. PATENT DOCUMENTS

| | | | | |
|---|---|---|---|---|
| 5,267,323 | A | 11/1993 | Kimura | |
| 5,515,445 | A * | 5/1996 | Baumhauer et al. | 381/92 |
| 5,528,731 | A * | 6/1996 | Sachs et al. | 704/246 |
| 5,737,485 | A * | 4/1998 | Flanagan et al. | 704/232 |
| 5,765,124 | A * | 6/1998 | Rose et al. | 704/242 |
| 6,219,645 | B1 * | 4/2001 | Byers | 704/275 |
| 6,275,800 | B1 * | 8/2001 | Chevalier et al. | 704/246 |

FOREIGN PATENT DOCUMENTS

DE 43 12 155 10/1994

OTHER PUBLICATIONS

Lin, Q. et al., "Robust Distant-Talking Speech Recognition", (1996) IEEE International Conference on Acoustics, Speech, & Signal Processing, vol. 1, XP002108726, pp. 21-24.

* cited by examiner

*Primary Examiner*—Abul K. Azad
(74) *Attorney, Agent, or Firm*—Bell Boyd & Lloyd

(57) ABSTRACT

An apparatus and a method for speech recognition are provided, by which, whereby the speech is optionally input via a microphone (14) close to the speaker or a microphone (20) remote from the speaker. A correction unit (15) is connected into the transmission channel (12) with microphone (14) close to the speaker, the correction unit modifying the electrical speech signal in such a way that it contains room transmission characteristics.

11 Claims, 2 Drawing Sheets

APPARATUS AND METHOD FOR SPEECH RECOGNITION

The invention relates to an apparatus for speech recognition in which the speech is optionally converted into electrical signals via a microphone close to the speaker and is supplied to a recognition system via a first transmission channel, or is converted into electrical signals via a microphone remote from the speaker and is supplied to the recognition system via a second transmission channel, and in which the recognition system compares the speech elements recorded using the respective microphone with speech elements learned previously in a training phase, and, in case of agreement, produces a recognition signal. In addition, the invention relates to a method for speech recognition.

DESCRIPTION OF THE RELATED ART

In the recognition of speech or of speech elements, there is often the difficulty that the speech elements input via a microphone are affected by and overlaid with variance in room acoustics. The transmission characteristics of the room/space can significantly influence the recognition rate of the recognition system. Previously realized apparatuses and methods for speech recognition do not take into account changes in the transmission function of the room. In general, in the previous apparatuses and methods it has been assumed that the transmission function in the transmission of the speech of a person remains the same up to the digital recording, both in the training phase and also in later use for speech recognition, in particularly in the case of speaker-dependent speech recognition.

However, in speech recognition via e.g., a telephone, such an assumption is not made, because telephone systems currently in use have the possibility of switching between a telephone close to the speaker, in which the microphone of the telephone handset is held close to the mouth of the speaker, and a microphone remote from the speaker, in which (in a hands-free state, the microphone records voices at a greater distance. The typical distance for a microphone close to the speaker is in the range from 0 to 30 cm, that is, predominantly direct sound is converted into electrical signals. For microphone remote from the speaker, the distance is greater, and direct sound elements are mixed together resulting from echo effects, wall reflections, and direct sound. If the microphone close to the speaker is used during the training phase and a microphone remote from the speaker is used later, the recognition rate is deceased due to the different room transmission functions, as a result of the different transmission paths.

SUMMARY OF THE INVENTION

The object of the invention is to indicate an apparatus and a method for speech recognition that operates with high reliability, independent on the speaker's distance from a microphone.

This object is achieved by an apparatus for speech recognition, comprising a microphone close to a speaker or a microphone remote from the speaker, which produces electrical signals from speech elements of the speaker; a recognition system to which the electrical signals are supplied, the electrical signals being supplied via a first transmission channel when the microphone is a microphone close to the speaker, and the electrical signals being supplied via a second transmission channel when the microphone is a microphone remote from the speaker, the recognition system comparing speech elements recorded by the microphone with speech elements learned previously in a training phase, and, in case of agreement, producing a recognition signal; a correction unit connected into the first transmission channel, the correction unit modifying the electrical signals in such a way that they have room transmission characteristics as they occur in recording with a microphone remote from the speaker. The correction unit can be configured to simulate acoustic reflections from nearby objects and/or room reverberation. The correction unit may be fashioned as a stationary filter or an adaptive filter, and the adaptive filter's parameters can be set depending on recorded audio signals. Each microphone may also attach to a preamplifier. Compensation filters may also be provided for the compensation of varying microphone and amplifier frequency response characteristics. The recognition system may use a spectral analysis or an LPC ceptral analysis as its method.

The object of the invention is also achieved by a method for speech recognition, comprising the steps of: converging speech elements of a speaker into electrical signals using a microphone close to the speaker or a microphone remote from the speaker; supplying the electrical signals from the microphone, when the microphone is a microphone close to the speaker, to a recognition system via a first transmission channel; supplying the electrical signals from the microphone, when the microphone is a microphone remote from the speaker, to the recognition system via a second transmission channel; recording speech elements in a training phase; recording speech elements with the microphone in an operating phase; comparing the recorded speech elements in the training phase with the recorded speech elements in the operating phase in the recognition system and, in case of agreement, producing a recognition signal; modifying the electrical signals from the first transmission channel in such a way that they have room transmission characteristics as they occur during recording with the microphone remote from the speaker. The correction unit can simulate acoustic reflections from nearby objects and/or room reverberations.

According to the invention, a correction unit is connected into the first transmission channel that modifies the electrical signal in such a way that it contains room transmission characteristics. Thus, the speech input via a microphone close to the speaker is modified in the electrical signal in such a way that it has the characteristics of speech that has been input via the microphone remote from the speaker. Thus, the correction unit is used to simulate the room acoustic influences for a relatively large speech transmission path. The correction unit stimulates, for example acoustic reflections from nearby objects and/or room reverberation.

BRIEF DESCRIPTION OF THE DRAWINGS

An exemplary embodiment of the invention is explained in the following on the basis of the drawings.

DESCRIPTION OF THE PREFERRED EMBODIMENTS

Figure 1:
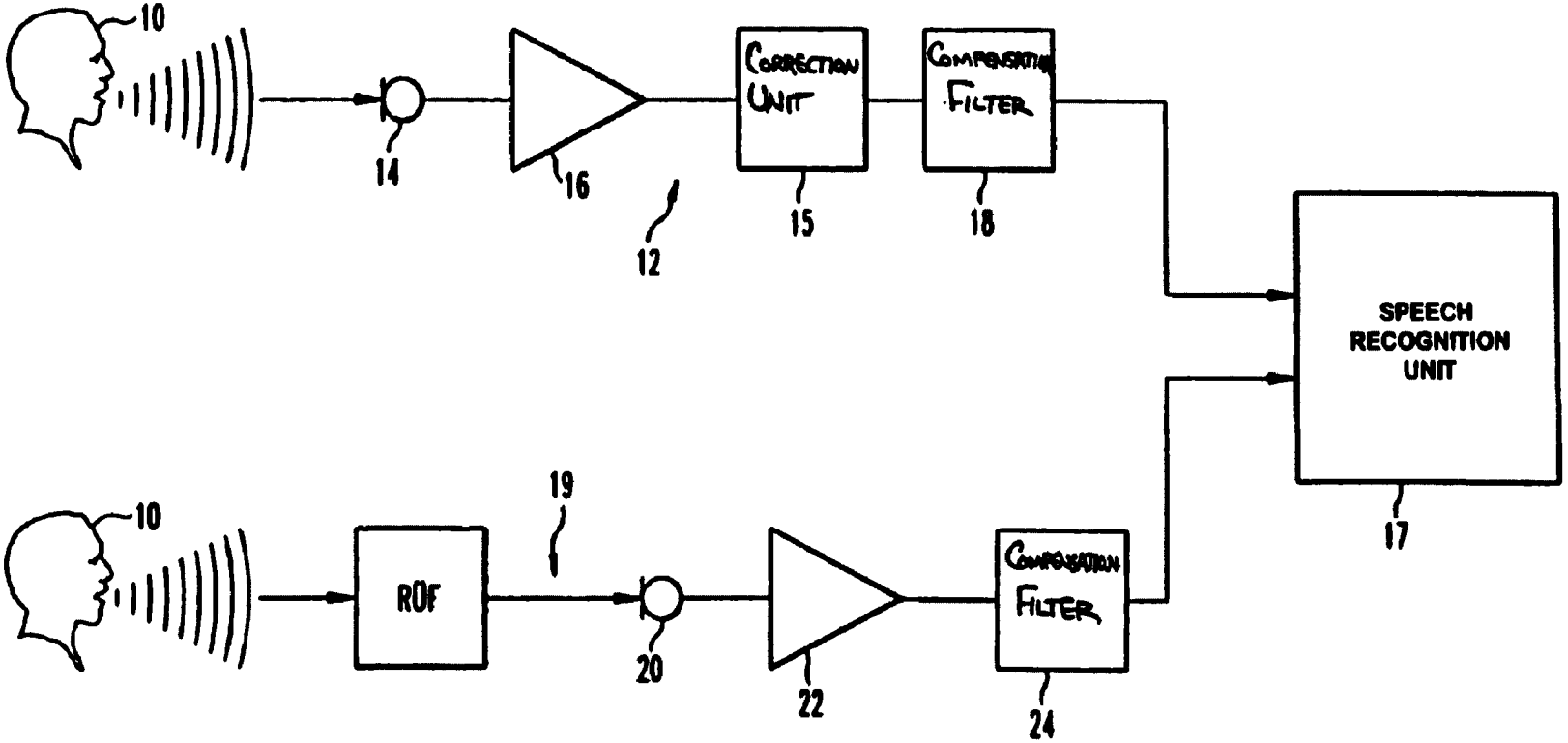
FIG. 1 is a schematic diagram showing an apparatus for speech recognition in which the speech input via a telephone.

FIG. 1 shows an apparatus for speech recognition in which the speech is inputted by a person 10 using a telephone. In the upper, first transmission channel 12, the speech is input using a microphone 14 close to the speaker, for example with the handset. The speech is converted into an electrical signal by the microphone 14 and is pre-amplified by an amplifier 16. A correction unit 15 modifies the electrical signal in such a way that it has transmission characteristics of a room with a transmission path greater than close range. This correction unit 15, for example simulates room reverberation and/or sound reflections from nearby objects within the speech transmission path. Acoustic reflections of this sort can for example, originate from a desktop, a display screen, or from other objects. In contrast, room reverberation originates from relatively distant objects, such as for example, from the walls of the room. The electrical signal modified by the correction unit 15 runs through a compensation filter 18 that is used for the compensation of varying microphone and amplifier frequency response characteristics. The electrical signal is then supplied to a speech recognition unit 17, which carries out the further digital processing for the speech recognition.

In the lower part of FIG. 1, the inputting of speech elements via a hands-free apparatus is shown. The speech of the person 10 is modified by a special room transmission function RUF, i.e., the speech elements according to the microphone 20 from the speaker 10 are for example overlaid with acoustic reflections from nearby objects and with room reverberation, and possible, with foreign noises. The electrical signal of the microphone 20 remote from the speaker is pre-amplified by a pre-amplifier 22, and is supplied to a compensation filter 24 for the compensation of varying microphone and amplifier frequency response characteristics. The electrical signal filtered in this way is supplied to the speech recognition unit 17 for speech recognition.

In operation of the apparatus shown in FIG. 1, during a training speech samples are stored in the data processing device 17. Which could be used, for example, to construct a personal telephone directory. For this purpose, during the training phase, the name of a subscriber is spoken at least twice and is stored in a personal telephone directory with the telephone number associated with the name. After the end of the training phase, in the use/operating phase the name is once again input, by which the data processing device 17 tries, using recognition methods such as spectral analysis or LPC ceptral analysis, to recognize this name again on the basis of the previously stored name. In the case of a positive result, outputs the telephone number stored under this name and sets up the telephone connection. After the correction unit 15 produces, in the transmission channel 12, an electrical speech signal having the same room characteristics as the speech signal of the second transmission channel 19, it is irrelevant for the speech recognition whether the microphone 14 or, microphone is used during the training phase or during the re-recognition phase. Thus, using the correction unit 15, it is possible to use the telephone both with the handset and also in hands-free operation.

Figure 2:
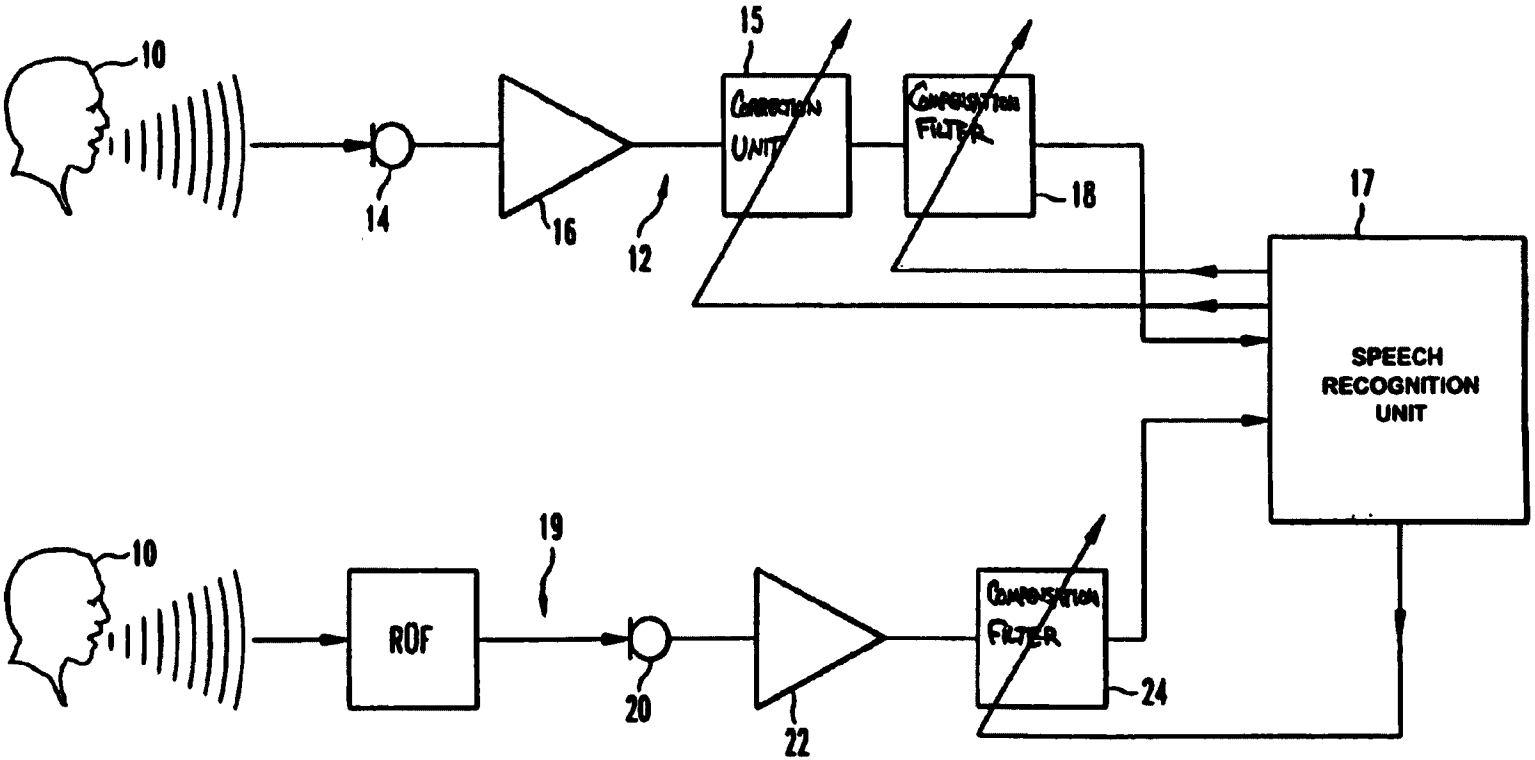
FIG. 2 is a schematic diagram showing an apparatus according to FIG. 1 having adaptive filters.

FIG. 2 shows a variant of the apparatus according to FIG. 1. In contrast to the apparatus according to FIG. 1, the correction unit 15 is fashioned as an adaptive filter, that is, the filter parameters are varied in depending on the recorded audio signals. In this way the recognition rate can be increased. The compensation filters 18 or, respectively, 24 in the two respective transmission channels 19 are also fashioned as adaptive filters; their filter parameters are set dependent on the recorded audio signals.

What is claimed is:

1. An apparatus for speech recognition, comprising:

a microphone selected from a group consisting of a microphone close to a speaker and a microphone remote from said speaker, said microphone producing electrical signals from speech elements of said speaker;

a recognition system to which said electrical signals are supplied, said electrical signals being supplied via a first transmission channel when said microphone is said microphone close to said speaker, and said electrical signals being supplied via a second transmission channel when said microphone in said microphone remote from said speaker, said recognition system comparing speech elements recorded by said microphone with speech elements learned previously in a training phase and, in case of agreement, producing a recognition signal; and a correction unit connected into said first transmission channel, said correction unit modifying said electrical signals such that said electrical signals have room transmission characteristics substantially as they occur in recording with said microphone remote from said speaker.

2. The apparatus according to claim 1, wherein said correction unit simulates acoustic reflections from nearby objects.

3. The apparatus according to claim 1 wherein said correction unit simulates room reverberation.

4. The apparatus according to claim 1, wherein said correction unit is fashioned as a filter selected from the group consisting of a stationary filter and an adaptive filter.

5. The apparatus according to claim 4, wherein said filter is an adaptive filter whose filter parameters are set in dependence on recorded audio signals.

6. The apparatus according to claim 1, further comprising:

a preamplifier for said microphone in said first transmission channel; and a preamplifier for said microphone in said second transmission channel, when said second transmission channel is present.

7. The apparatus according to claim 1, further comprising:

a compensation filter in said first transmission channel; and a compensation filter in said second transmission channel, when said second transmission channel is present;

said compensation filters being provided for compensation of varying microphone and amplifier frequency response characteristics.

8. The apparatus according to claim 1, wherein said recognition system uses a speech recognition method selected from the group consisting of spectral analysis and LPC cepstral analysis.

9. A method for speech recognition, comprising the steps of:

converting speech elements of a speaker into electrical signals using a microphone selected from the group consisting of a microphone close to said speaker, and a microphone remote from said speaker;

supplying said electrical signals from said microphone, when said microphone is a microphone close to said speaker, to a recognition system via a first transmission channel;

supplying said electrical signals from said microphone, when said microphone is a microphone remote from said speaker, to said recognition system via a second transmission channel;

recording speech elements in a training phase;

recording speech elements with said microphone in an operating phase;

comparing said recorded speech elements in said training phase with said recorded speech elements in said operating phase in said recognition system and, in case of agreement, producing a recognition signal; and modifying said electrical signals from said first transmission channel such that said electrical signals have room transmission characteristics substantially as they occur during recording with said microphone remote from said speaker.

10. The method according to claim 9, further comprising the step of simulating acoustic reflections from nearby objects with said correction unit.

11. The method according to claim 9, further comprising the step of simulating room reverberation with said correction unit.

* * * * *